US005429280A

United States Patent [19]

Bauer et al.

[11] Patent Number: 5,429,280

[45] Date of Patent: Jul. 4, 1995

[54] FLUID DISPENSING CONTAINER FOR DISPENSING A PREDETERMINED QUANTITY OF A LIQUID

[75] Inventors: Daniel Bauer, Le Raincy; Dominique Esclar, Herpy-l'Arlesienne; Gérard Braque, Mitry-le-Neuf, all of France

[73] Assignee: L'Oreal, Paris, France

[21] Appl. No.: 137,001

[22] PCT Filed: Feb. 18, 1993

[86] PCT No.: PCT/FR93/00159

§ 371 Date: Oct. 13, 1993

§ 102(e) Date: Oct. 13, 1993

[87] PCT Pub. No.: WO93/16941

PCT Pub. Date: Sep. 2, 1993

[30] Foreign Application Priority Data

Feb. 24, 1992 [FR] France ..... 92 02087

[51] Int. Cl.[6] ..... B65D 83/14

[52] U.S. Cl. ..... 222/402.2

[58] Field of Search ..... 222/61, 649, 402.2

[56] References Cited

U.S. PATENT DOCUMENTS

| | | | |
|---|---|---|---|
| 2,778,543 | 1/1922 | Urlaub | 222/402.2 |
| 2,815,889 | 12/1957 | Stetz et al. | 222/402.2 X |
| 3,104,785 | 9/1963 | Beard | 222/402.2 |
| 3,169,677 | 2/1965 | Focht | 222/402.2 |
| 3,235,135 | 2/1966 | Robert et al. | 222/402.2 X |
| 3,246,809 | 4/1966 | Ward | 222/402.2 |
| 3,377,004 | 4/1968 | Kjelson | 222/402.2 |
| 3,519,171 | 7/1970 | Kinnavy | 222/402.2 |
| 4,142,652 | 3/1979 | Platt | 222/402.2 |
| 4,154,378 | 5/1979 | Paoletti et al. | 222/394 |
| 4,433,797 | 2/1984 | Gailia | 222/402.2 X |
| 4,577,784 | 3/1986 | Brunet | 222/402.2 |

FOREIGN PATENT DOCUMENTS

| | | |
|---|---|---|
| 1290166 | 3/1962 | France . |
| 2370213 | 6/1978 | France . |
| 2050303 | 1/1981 | United Kingdom . |

*Primary Examiner*—Andres Kashnikow
*Assistant Examiner*—Kenneth Bomberg
*Attorney, Agent, or Firm*—Young & Thompson

[57] ABSTRACT

Fluid dispensing container (1) equipped with a dispensing valve (2) carrying an outlet (3) through which the fluid is dispensed during the actuation of a pushbutton carried by the valve; a conditioning chamber (4) of variable volume defined by a mobile wall (5*a*) subjected to the internal pressure of the container, communicates, on the one hand, with the dispensing valve (2) and, on the other hand, with the inside (18) of the container through a retarder made in the form of a passage with high head loss. At the end of emptying of the conditioning chamber (4), the communication between the dispensing valve (2) and the inside (18) of the container is interrupted.

6 Claims, 3 Drawing Sheets

FLUID DISPENSING CONTAINER FOR DISPENSING A PREDETERMINED QUANTITY OF A LIQUID

FIELD OF THE INVENTION

The invention relates to a fluid dispensing container equipped with a dispensing means carrying an outlet means through which the fluid is dispensed during operation of the dispensing means. In numerous applications, such a dispensing container is used for dispensing toxic or inflammable fluids and thereby presents some danger if it is, accidentally or otherwise, used continuously, considering the quantity of fluid contained in the container, which is intended in general for a plurality of uses.

THE KNOWN PRIOR ART

It has already been proposed, in Patent GB-A-2,050,303 to equip a dispensing container of the aerosol canister type with a metering chamber so as to limit the quantity of fluid dispensed in one utilization: it is clear that such an arrangement is not sufficient to overcome the above drawback because numerous successive uses are possible.

It has also been proposed, in U.S. Pat No. 3,519,171, for preventing complete and therefore dangerous emptying of an aerosol canister, to fit said canister with a ball device, which, at the end of a certain dispensing time, blocks the passage of the fluid to be dispensed through the dispensing means and is held in this position by the action of the pressure of the fluid to be dispensed due to the propellent gas, as long as this action is not balanced by the pressure of a space, separated from the inside of the canister by a membrane permeable to the propellent gas, the structure of this membrane defining a time, at the end of which the ball will free the passage of the fluid to be dispensed towards the dispensing means. The device according to this U.S. Pat. No. 3,519,171, although effectively preventing complete emptying of the canister, makes metering of the quantity of fluid to be dispensed inaccurate, or even random; it will furthermore be noted that it is complex to produce.

U.S. Pat. No. 3,377,004 shows a dispensing container comprising a discharge valve and a bellows, placed in the container connected to the valve; the whole makes it possible to deliver a metered quantity of product. However, there is no short cutoff of the dispensing at the end of the dose.

OBJECT OF THE INVENTION

The subject of the present invention is a fluid dispensing container, with simple construction, making it possible to avoid all the above drawbacks; by virtue of the dispensing container according to the invention, a precise quantity of fluid may be dispensed during one utilization and the dispensing container cannot be continuously emptied.

SUMMARY OF THE INVENTION

According to the invention, a fluid dispensing container equipped with a dispensing means carrying an outlet means through which the fluid is dispensed when the dispensing means is operated, said container comprising on the inside a conditioning chamber communicating with the inside of the container through retarding means made in the form of a passage with high head loss for retarding the supplying of said conditioning chamber with fluid to be dispensed, the conditioning chamber having a variable volume defined by walls, at least one of which is subjected to the internal pressure of the container and is mobile, said conditioning chamber being supplied with fluid to be dispensed through the passage with high head loss and also communicating with the dispensing means, is characterized in that, when the mobile wall is in the position in which the volume of the conditioning chamber is a minimum, the communication between the inside of the container and the dispensing means is interrupted.

A well-defined cutoff of the dispensing is thus obtained.

The communication can be interrupted by the mobile wall itself.

Advantageously, the mobile wall of the conditioning chamber comprises an elastic bellows. At the end of emptying of the conditioning chamber, the elastic bellows comes to block a calibrated orifice constituting the retarding means.

As a variant, the mobile wall of the conditioning chamber may comprise a flexible membrane. At the end of emptying of the conditioning chamber, the membrane comes to bear against the internal surface of the container, which blocks a calibrated orifice provided in the membrane and constitutes the retarding means.

Advantageously, at the end of emptying of the conditioning chamber, the mobile wall, in particular the membrane, may come to block the orifice of the immersed tube.

According to another variant embodiment, the conditioning chamber is of cylindrical shape and the mobile wall is a piston mounted so as to slide in the cylinder; the piston may come to block the orifice of the immersed tube at the end of emptying of the conditioning chamber.

Preferably, the retarding means are provided in the mobile wall.

Said retarding means may consist of the clearance of mounting of the piston in the cylinder or of a calibrated channel passing through the piston and joining the two volumes of the cylinder situated on either side of the piston.

The piston may be of spherical shape. This piston may also be of cylindrical shape.

The retarding means advantageously consist of a calibrated orifice whose diameter regulates the retardation.

The dispensing container may be an aerosol canister containing the fluid to be dispensed and a pressurized propellent fluid, the dispensing means being a dispensing valve.

Advantageously, the aerosol canister comprises an immersed tube connected at one end to the dispensing valve, the conditioning chamber being connected to the other end of the immersed tube, so that the communication of the conditioning chamber with the dispensing valve occurs through the immersed tube.

The dispensing container may be equipped with a pump operated manually and the conditioning chamber is arranged between the internal volume of the container and the entry of the pump.

BRIEF DESCRIPTION OF THE DRAWINGS

The invention will be described in more detail hereinbelow, purely by way of illustration and non-limitingly, with regard to particular embodiments represented in the attached drawings.

In these drawings

DETAILED DESCRIPTION OF THE INVENTION

Figure 1:
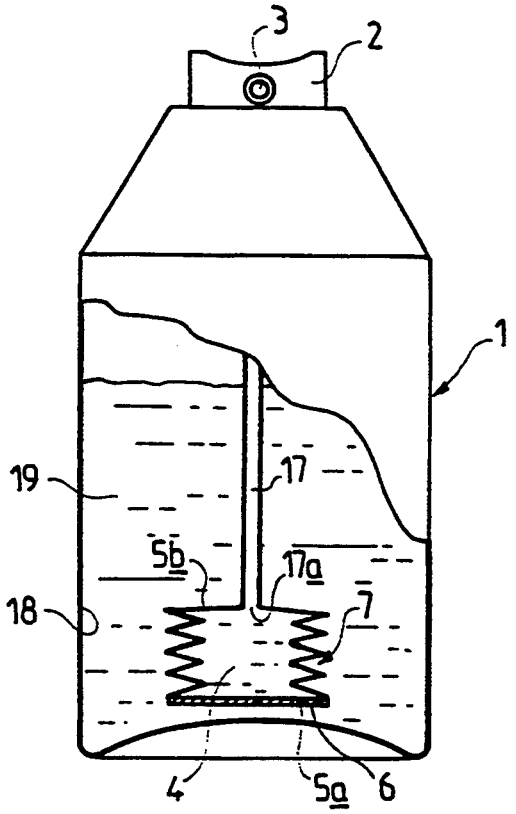
FIGS. 1 and 2 diagrammatically show a first embodiment of a dispensing container of the aerosol canister type, equipped with a conditioning chamber, according to the invention, in the two extreme positions of the mobile walls of the conditioning chamber.
Figure 2:
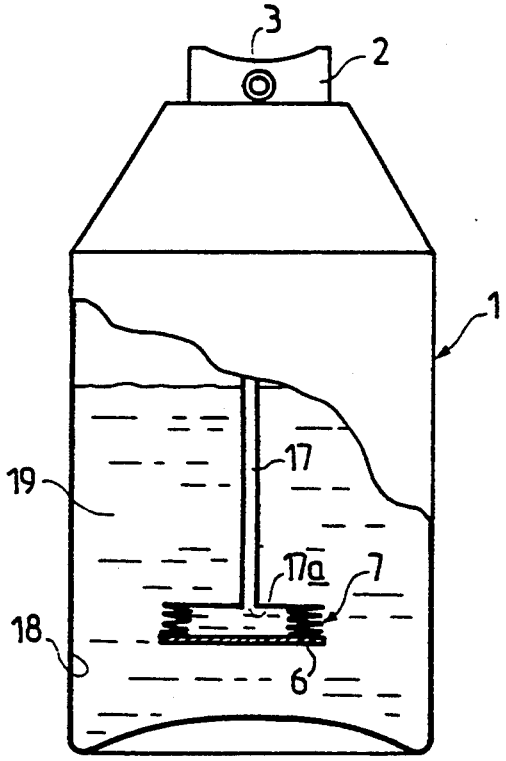

A dispensing container is diagrammatically illustrated at 1 in FIG. 1; the dispensing container 1 is of the aerosol canister type, the inside 18 of the dispensing container 1 containing a fluid to be dispensed 19 subjected to the internal pressure generated by a propellent fluid, as is known per se; the dispensing means is here a conventional dispensing valve 2 which allows, by action on a pushbutton carried by the valve 2, dispensing of fluid sprayed through a nozzle 3, the fluid previously passing through an immersed tube 17. The tube 17 is in communication at 17*a* with a conditioning chamber 4 consisting, according to the example represented in this figure, of a bellows 7 of cylindrical general shape, the elastic cylindrical part being solidly attached in a leaktight manner by its ends to two plates 5*a* and 5*b*; the plate 5*a* is provided with a calibrated orifice 6. This orifice 6 is situated in the vicinity of the edge of the plate 5*a*, under a fold of the bellows 7. The whole is such that when the bellows 7 is folded, as illustrated in FIG. 2, where the volume of the chamber 4 is a minimum, the orifice 6 is blocked by the bellows 7. Any communication between the inside 18 of the container and the chamber 4 is thus cut off. Any communication between the inside 18 and the tube 17 is therefore also cut off.

In the position represented in FIG. 1, the bellows 7 is expanded and filled with the fluid to be dispensed, the internal pressure of the container prevailing throughout the container, including within the connecting chamber 4. The orifice 6 is open.

The operation in utilization of such a dispensing container is as follows:

By actuating the pushbutton carried by the dispensing valve, for opening the closure member which said valve contains, as is known per se, and is therefore not represented, the user causes the immersed tube 17 and therefore the conditioning chamber 4 to communicate with the atmosphere; the fluid is sprayed through the nozzle 3; the conditioning chamber 4 decreases in volume under the action of the internal pressure of the container: it will be noted that, during the time for which the emptying of the chamber 4 will last, the spraying will be produced under constant pressure, namely the internal pressure of the container. As will easily be understood, the emptying will cease even if the user continues his pressing action on the pushbutton of the dispensing valve, when the chamber 4 reaches its minimum volume, for example when the folds of the bellows adjoin: this is the position which is represented in FIG. 2. The orifice 6 is then closed and the spraying is stopped sharply.

In order to be able to use the dispensing container again, the user will have to wait for at least partial filling of the chamber 4, which will occur through the calibrated orifice 6 which therefore constitutes a retarding means, which retardation depends on the caliber of the orifice 6. The volume of the chamber 4 is chosen such that it defines the maximum authorized quantity of fluid to be dispensed. It should be noted that, in the expanded position of the bellows, the orifice 6 is next to the bottom of the container, so that as much of the fluid contained in the container as possible can be involved in the filling of the chamber 4.

In order to give an order of magnitude of the relative capacities of the chamber and of the container, in the case when, for example, the fluid to be dispensed is hairspray, the conditioning chamber has a capacity of 20 to 30 $cm^3$, corresponding to 2 or 3 applications and the calibrated orifice 6 is such that it is necessary to wait 15 minutes for the chamber 4 to pass from the position in FIG. 2 to that in FIG. 1. Thus, by virtue of the invention, the risks linked with a high concentration of fluid in the room where the fluid 19 is dispensed are greatly limited.

Figure 3:
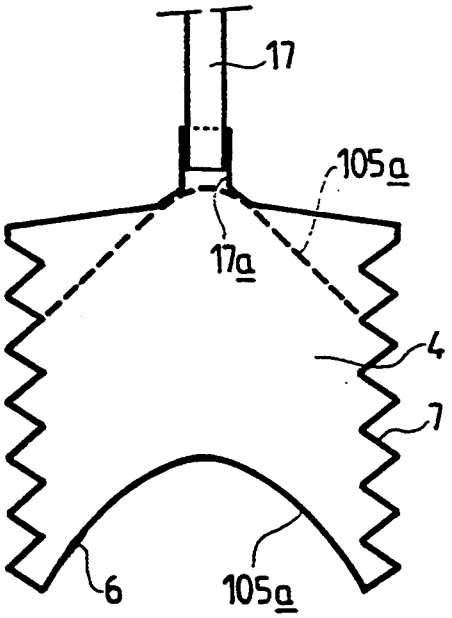
FIG. 3 shows one variant embodiment of the conditioning chamber of the example in FIG. 1.

FIG. 3 shows one variant embodiment of the conditioning chamber 4 of FIG. 1. The bottom 105*a* of the bellows has a domed shape, which is convex toward the inside of the chamber 4. The whole is such that, when the chamber 4 has its minimum volume at the end of emptying, the bottom 105*a* occupies the position represented in dashed lines in FIG. 3: the top of the domed bottom 105*a* comes to block the orifice 17*a* of the immersed tube 17 and to generate the interruption of the dispensing.

The calibrated orifice 6 is provided toward the edge of the bottom away, in the radial direction, from the top of the bottom 105*a*.

Figure 4:
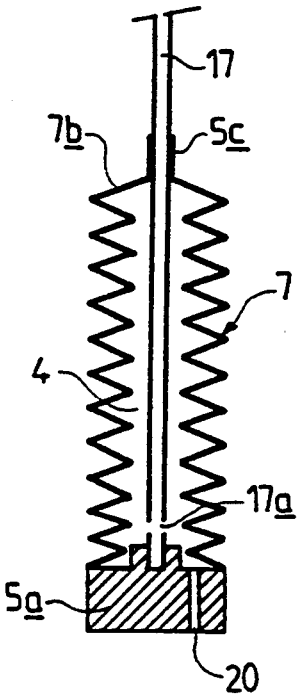
FIG. 4 shows one variant of mounting of the conditioning chamber of the type of that described in FIG. 1.

In FIG. 4, the conditioning chamber 4 is also defined within a bellows 7, but according to this variant, the tube 17 is solidly attached to the plate 5*a* provided with retarding means consisting of a calibrated channel 20, while the upper part 5*c* of the bellows 7 is mounted so as to slide in a leaktight manner on the immersed tube 17 which communicates with the conditioning chamber 4 by virtue of a diametral orifice 17*a* provided for this purpose in the wall of the immersed tube.

The channel 20 is arranged in the vicinity of the edge of the plate 5*a*, under the folds of the bellows 7. When the volume of the chamber 4 is a minimum, the folded bellows 7 blocks the channel 20 as in the case of FIG. 2.

Figure 5:
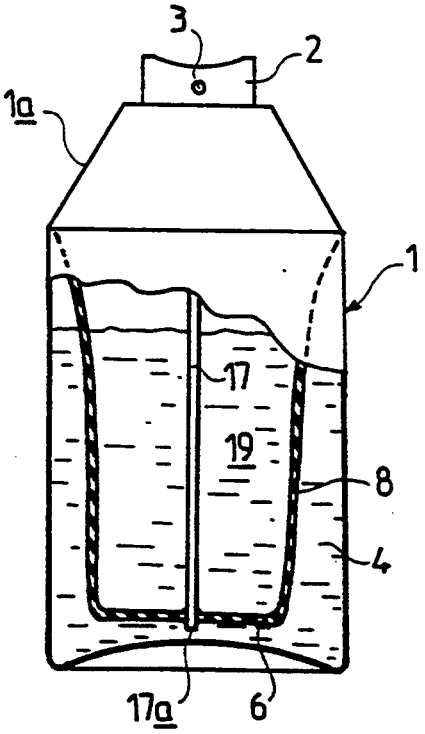
FIGS. 5 and 6 diagrammatically show a second embodiment of a dispensing container of the aerosol canister type, equipped with another variant conditioning chamber, according to the invention, in the two extreme positions of its mobile walls.
Figure 6:
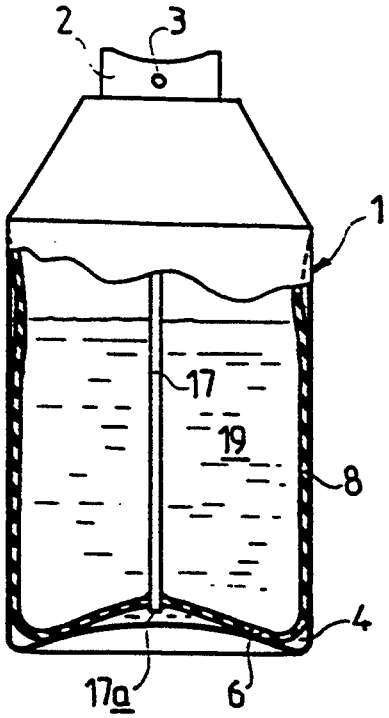

FIGS. 5 and 6 diagrammatically show a second embodiment of a dispensing container of the aerosol canister type, equipped with another conditioning chamber variant according to the invention. A cylindrical deformable elastic membrane 8, whose upper part is open, has its circumferential edge solidly attached to the container 1 by crimping of the cylindrical part of the container and of its conical part 1*a*, as normally carried out, and its bottom solidly attached to the lower end of the tube 17 which passes through it and emerges at 17*a* in the space contained between the internal wall of the container and the membrane 8; this space constitutes the conditioning chamber according to the invention, whose mobile wall subjected to the internal pressure of the container is the membrane 8. The bottom of said membrane comprises retarding means 6 consisting of a calibrated hole. The aerosol canister of FIG. 5 operates in the same manner as that described with respect to FIG. 1. In the case of FIG. 5, the spraying of fluid 19 ceases when, under the action of the internal pressure, the membrane 8 comes to bear against the internal surface of the canister, as illustrated in FIG. 6, so that the calibrated orifice 6 is blocked.

Figure 7:
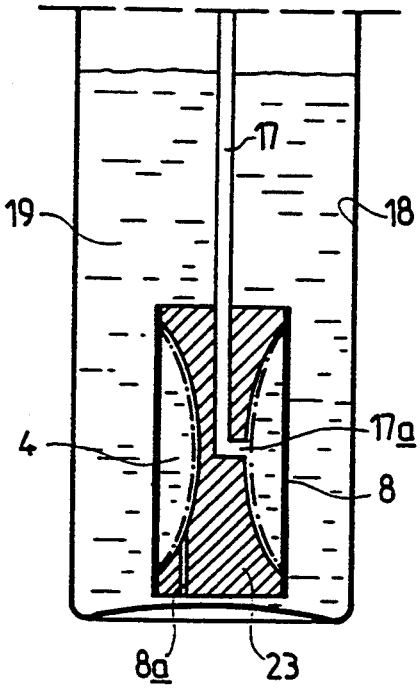
FIGS. 7 and 8 show two other conditioning chamber variants of the type of that in FIG. 5.
Figure 8:
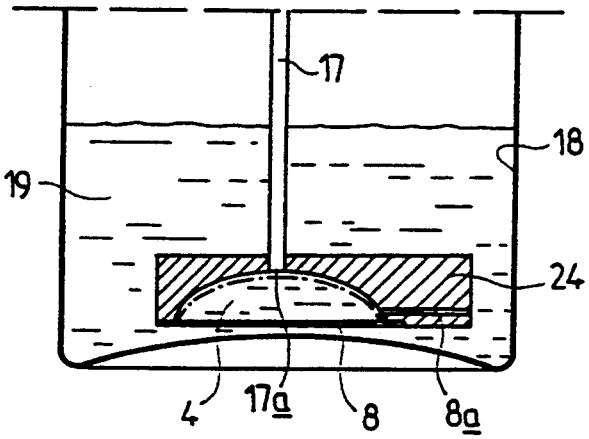

FIGS. 7 and 8 show membrane conditioning chamber variants the tube 17 is solidly attached to a membrane holder piece designed to receive an elastic membrane while allowing it the possibility of displacement, the volume generated by the membrane during its displacement constituting the conditioning chamber 4 with variable volume according to the invention; according to FIG. 7, the membrane holder piece 23 is in the shape of a diabolo and the membrane 8 is cylindrical and fastened in a leaktight manner to the two ends of the diabolo. The membrane 8 is represented in dot-and-dash lines in FIG. 7 in the position where the internal pressure presses it onto the surface of the diabolo, in which position the spraying has ceased. A calibrated aperture 8*a* in the piece 23 ensures the retardation of the filling of the chamber 4. At the end of emptying of the chamber 4, the orifice 17*a* is closed by the membrane 8. Any communication between the dispensing valve and the chamber 4 is interrupted. The membrane 8 also blocks the calibrated aperture 8*a*.

According to the variant in FIG. 8, the membrane holder piece 24 has a hermispherical cavity closed by the membrane 8.

Figure 9:
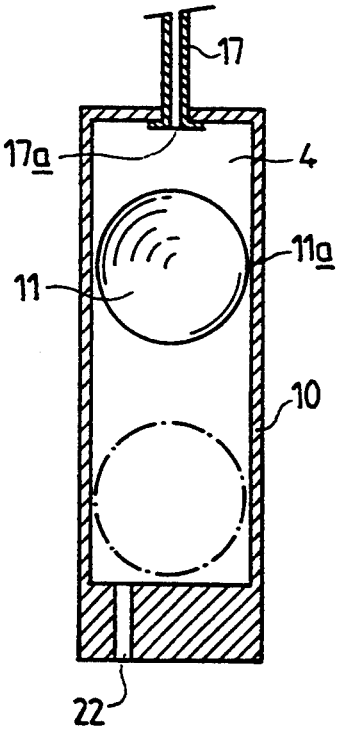
FIGS. 9, 10 and 11 show other conditioning chamber examples according to the invention.
Figure 10:
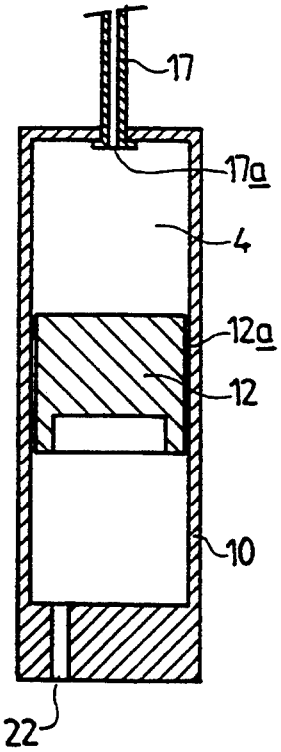
Figure 11:
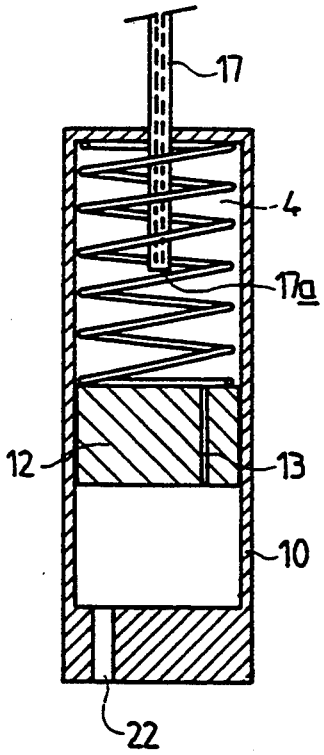

FIGS. 9, 10 and 11 show other examples of conditioning chambers 4 according to the invention, defined by the volume bounded by a cylinder 10 in which a piston moves, said piston constituting the mobile wall of said chamber 4 subjected to the action of the internal pressure of the container. Clearly, the representation is diagrammatic: in FIG. 9, the piston 11 is spherical and the chamber 4 is defined between the sphere 11 and the cylindrical wall of the cylinder 10, closed at its upper part which receives the tube 17 which emerges at 17*a* into the chamber 4; the clearance 11*a* of mounting of the spherical piston 11 in the cylinder 10 defines the retardation according to the invention; the inside of the cylinder situated opposite the chamber 4 with respect to the piston 11 is in wide communication at 22 with the inside of the container and the fluid to be dispensed which is present therein; according to the variants in FIGS. 10 and 11, the piston is cylindrical; according to FIG. 10, the retardation according to the invention is ensured by the clearance 12*a* of mounting of the piston in its cylinder; by FIG. 11, it is further-more ensured by a calibrated passage 13 passing longitudinally through the piston 12. During the filling of the chamber 4, the piston may be subjected to the action of a return spring, as illustrated in FIG. 11; this spring will obviously be involved in the definition of the retardation.

At the end of emptying, when the volume of the chamber 4 is a minimum, the piston 11 or 12 comes to close the orifice 17*a*.

It will be seen that, whatever the prescribed forms of the conditioning chamber according to the invention, it is impossible completely to empty the dispensing container continuously. In practice, the normal duration of atomization is short: it does not in general exceed 10 seconds for an insecticide, 15 seconds for a hairspray, 5 seconds for a deodorant, etc. A dispensing container is in general intended for 20 to 50 uses, it may be emptied in 2 to 25 minutes depending on the case; by virtue of the invention, and in the case of a retardation of 15 minutes, hours could be required to empty the container completely, and it is therefore considered to be a safety dispensing container.

The examples described and represented show the application of the invention to aerosol canisters comprising a propellent fluid and an immersed tube; it is evident that the invention applies also not only to aerosol canisters without an immersed tube but also to dispensing containers without propellent fluid, which are then equipped with a pump operated manually, the conditioning chamber being arranged between the internal volume of the container and the entry of the pump. The invention may be applied also to dispensing containers for compressed gaseous fluids, such as chemical gases such as for example chlorine, hydrogen, which are fitted with various dispensing means (tap, etc.).

It should be noted that it is advantageous to make the means for communication of the conditioning chamber with the fluid to be dispensed, for filling said chamber, be arranged, at the time of filling, as close as possible to the lower wall of the container.

Figure 12:
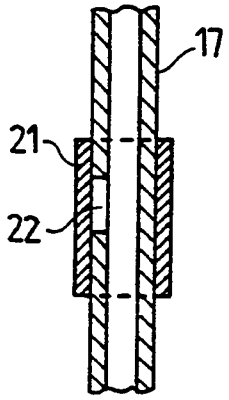
FIG. 12, finally, represents one example of means for rapid filling of a dispensing container of the aerosol canister type equipped with a conditioning chamber according to the invention.

In the case where the invention is applied to an aerosol canister, which is pressurized by means of the dispensing valve, since the conditioning chamber is arranged between the inside of the container and the immersed tube, the retarding means make this pressurization operation lengthy; to avoid this drawback, it is useful to provide a wide passage in the valve in direct communication with the inside of the container and to fit this wide passage with a non-return valve which allows the pressurization and is held closed by the internal pressure of the container; for example, if the aerosol canister is provided with an immersed tube, it is practical to equip the latter with a passage fitted with a closure member: FIG. 12 shows an example of a tube 17 provided with a wide radial orifice 22 interacting with an elastic cylindrical sleeve 21 threaded tightly over the tube 17; the pressure in the tube 17 lifts the sleeve 21 when the container is pressurized through the tube 17 and keeps the container under pressure when the operation is finished.

I claim:

1. Fluid dispensing container (1) equipped with a dispensing means (2) carrying an outlet means (3) through which fluid is dispensed when the dispensing means is operated, said container comprising on the inside a conditioning chamber (4) communicating with the inside (18) of the container through retarding means (6, 8*a*, 11*a*, 12*a*, 13, 20) made in the form of a passage with high head loss for retarding the supplying of said conditioning chamber (4) with fluid to be dispensed, the conditioning chamber having a variable volume defined by walls, at least one (5, 7, 8, 11, 12) of which is subjected to the internal pressure of the container and is mobile, said conditioning chamber (4) being supplied with fluid to be dispensed through the passage with high head loss and also communicating with the dispensing means (2), wherein, when the mobile wall (5, 7, 8, 11, 12) is in the position in which the volume of the conditioning chamber (4) is a minimum, the communication between the inside (18) of the container and the dispensing means (2) is interrupted, the conditioning chamber comprising an elastic bellows (7), a bottom (105*a*) of the bellows having a domed shaped, which is convex toward the inside of the chamber (4) and wherein, at the end of emptying of the chamber (4), the top of the domed bottom comes to block an orifice (17*a*) of an immersed tube (17).

2. Dispensing container according to claim 1, wherein the communication is interrupted by the mobile wall itself.

3. Dispensing container according to claim 1, wherein the retarding means (6, 8*a*, 11*a*, 12*a*, 13, 20) are provided in the mobile wall.

4. Dispensing container according to claim 1, wherein the retarding means consist of a calibrated orifice (6, 13, 20) whose diameter regulates the retardation.

5. Dispensing container according to claim 1, wherein the dispensing container (1) is an aerosol canister containing the fluid (19) to be dispensed and a pressurized propellent fluid, the dispensing means (2) being a dispensing valve.

6. Dispensing container according to claim 5, wherein the aerosol canister comprises an immersed tube (17) connected at one end to the dispensing valve (2), the conditioning chamber (4) being connected to the other end of the immersed tube (17), so that the communication of the conditioning chamber (4) with the dispensing valve (2) occurs through the immersed tube (17).

* * * * *